US006686133B2

(12) United States Patent
Friedel

(10) Patent No.: US 6,686,133 B2
(45) Date of Patent: Feb. 3, 2004

(54) PHOTOTHERMOGRAPHIC MATERIALS PROCESSABLE AT LOWER TEMPERATURES AND RECORDING PROCESSES THEREFOR

(75) Inventor: Horst Friedel, Neu Isenburg (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 10/100,932

(22) Filed: Mar. 19, 2002

(65) Prior Publication Data

US 2003/0064328 A1 Apr. 3, 2003

Related U.S. Application Data

(60) Provisional application No. 60/291,529, filed on May 16, 2001.

(30) Foreign Application Priority Data

Mar. 29, 2001 (EP) ..... 01000097

(51) Int. Cl.[7] ..... G03C 1/498

(52) U.S. Cl. ..... 430/350; 430/617; 430/619; 430/620

(58) Field of Search ..... 430/619, 350, 430/620, 617

(56) References Cited

U.S. PATENT DOCUMENTS

| | | | | |
|---|---|---|---|---|
| 4,258,129 A | * | 3/1981 | Ikenoue et al. | 430/620 |
| 5,380,635 A | | 1/1995 | Gomez et al. | |
| 5,434,043 A | | 7/1995 | Zou et al. | |
| 5,459,028 A | | 10/1995 | Ball | |
| 5,677,121 A | | 10/1997 | Tsuzuki | |

FOREIGN PATENT DOCUMENTS

| | | |
|---|---|---|
| DE | 2721828 A | 12/1977 |
| EP | 0 964 300 A1 | 12/1999 |

* cited by examiner

*Primary Examiner*—Thorl Chea
(74) *Attorney, Agent, or Firm*—Leydig, Voit & Mayer, Ltd.

(57) ABSTRACT

A photothermographic recording material comprising a support and a photo-addressable thermally developable element, the photo-addressable thermally developable element containing a mixture of a substantially light-insensitive silver salt of a monocarboxylic acid and a substantially light-insensitive compound exclusive of silver succinate represented by formula (I):

$$AgOOC—R^1—COOAg$$

wherein $R^1$ is a straight chain saturated or unsaturated hydrocarbon group with two or three carbon atoms, optionally substituted with one or more of =O, =S, $=CR^2R^3$, an alkyl group, an aryl group, an amino group, a substituted amino group, a cycloalkyl group, a hydroxy group, a thiol group, an alkyl sulphone group, an aryl sulphone group, an alkoxy group, an acyloxy group, a thioalkyl group, a thioaryl, a carbamic ester group, a halogen atom or a $—(C=O)R^4$ group; wherein if $R^1$ is substituted with two substituents selected from the group consisting of alkyl, thioalkyl, substituted amino and alkoxy groups the two substituents may jointly comprise the atoms necessary to complete a carbocyclic or heterocyclic ring; $R^2$ and $R^3$ are independently hydrogen or an alkyl, substituted alkyl, hydroxy or thiol; $R^4$ is a hydroxy, —OAg, alkoxy, alkyl or $—NHR^6$ group; $R^6$ is hydrogen or an alkyl group; an organic reducing agent for the mixture of substantially light-insensitive organic silver salts in thermal working relationship therewith, a photosensitive silver halide in catalytic association with said mixture of substantially light-insensitive organic silver salts, and a binder; a photothermographic recording process therewith.

9 Claims, No Drawings

PHOTOTHERMOGRAPHIC MATERIALS PROCESSABLE AT LOWER TEMPERATURES AND RECORDING PROCESSES THEREFOR

This application claims the benefit of U.S. Provisional Application No. 60/291,529 filed May 16, 2001, which is incorporated by reference.

FIELD OF THE INVENTION

The present invention relates to photothermographic recording materials and recording processes therefor.

BACKGROUND OF THE INVENTION

Thermal imaging or thermography is a recording process wherein images are generated by the use of image-wise modulated thermal energy.

In thermography three approaches are known:

1. Image-wise transfer of an ingredient necessary for the chemical or physical process bringing about changes in colour or optical density to a receptor element containing other of the ingredients necessary for the chemical or physical process followed by uniform heating to bring about the changes in colour or optical density.
2. Thermal dye transfer printing wherein a visible image pattern is formed by transfer of a coloured species from an image-wise heated donor element onto a receptor element.
3. Direct thermal formation of a visible image pattern by image-wise heating of a recording material containing matter that by chemical or physical process changes colour or optical density.

Thermographic materials of type 3 can be rendered photothermographic by incorporating a photosensitive agent which after exposure to UV, visible or IR light is capable of catalyzing or participating in a thermographic process bringing about changes in colour or optical density.

Research Disclosure number 17029, published in June 1978, gives a survey of different methods of preparing organic silver salts in section II. The invention examples of U.S. Pat. No. 5,380,635 and U.S. Pat. No. 5,434,043 describe the production of organic silver salts using fatty acids of the type HUMKO Type 9718 & Type 9022 from WITCO Co., which contain according to the manufacturer's catalogue a mixture of different fatty acids, in connection with their use in photothermographic recording materials. DE-OS 27 21 828 discloses a thermally developable light-sensitive material, consisting of a support, which contains thereon or in one or more layers at least (a) an organic silver salt, (b) a photocatalyst and (c) a reducing agent, wherein the organic silver salt (a) contains at least a silver salt with an uneven number of 21 or more carbon atoms; and examples with mixtures of two and three organic silver salts of monocarboxylic acids precipitated together, but all with 20 or more carbon atoms.

U.S. Pat. No. 5,459,028 discloses a heat-developable photographic recording material comprising: (a) at least one binder layer coated on a support, said binder layer comprising at least one light-sensitive silver halide and a light-insensitive silver salt of a fatty acid; (b) at least one reducing agent; and (c) at least one auxiliary layer containing a developed image stabilizer selected from the group consisting of hexamethylene tetramine and salts thereof, triazaadamantane and salts thereof and compounds derived from hexamethylene tetramine wherein the compounds are derived from hexamethylene tetramine by exchanging one —$CH_2$— group with —S—, —SO—, or —$SO_2$—; (d) wherein said reducing agent and said developed image stabilizers are in a reactive relationship with the light-insensitive silver salt.

U.S. Pat. No. 5,677,121 discloses a heat-developable silver halide infrared ray-sensitive material comprising a support having on one side of the support an emulsion layer containing a binder, a nonsensitive silver salt, a reducing agent for silver ion and silver halide grains spectrally sensitized at a wavelength within the region of from 750 to 1400 nm, wherein the nonsensitive silver salt comprises a mixture of silver salts of at least three organic carboxylic acids, one of the acids is behenic acid, and the content of the behenic acid in the acids is from not less than 35 to less than 90 mol %.

Recent experiments with substantially light-insensitive thermographic materials incorporating glutaric acid in the thermosensitive element have shown that, unlike substantially light-insensitive thermographic materials incorporating adipic acid or pimelic acid, silver glutarate could not be detected by X-ray diffraction spectroscopy during the thermal development process. Therefore there can be no question of incidental silver glutarate formation upon thermal development of substantially light-insensitive thermographic materials incorporating glutaric acid.

Photothermographic recording materials are required which are thermally processable at lower temperatures to enable a higher throughput to be realized and which are capable of providing images with a higher gradation.

ASPECTS OF THE INVENTION

It is therefore an aspect of the present invention to provide a photothermographic recording material with improved thermal developability without significant deterioration in other photothermographic properties.

It is therefore another aspect of the present invention to provide a photothermographic recording material capable of higher image gradation without significant deterioration in other photothermographic properties.

Other aspects and advantages of the present invention will become clear from the further description and examples

SUMMARY OF THE INVENTION

Surprisingly it has been found that thermal developability can be realized at lower temperatures without significant deterioration in other thermographic properties and images with higher gradation can be realized by using a mixture of particular substantially light-insensitive silver salts of monocarboxylic acids and particular light-insensitive silver salts of polycarboxylic acids. Particularly good results are obtained with a mixture of an equimolar mixture of silver glutarate and silver stearate.

According to the present invention a photothermographic recording material is provided comprising a support and a photo-addressable thermally developable element, the photo-addressable thermally developable element containing a mixture of substantially light-insensitive silver salts of organic carboxylic acids with one or more carboxylic acid groups, an organic reducing agent for the mixture of substantially light-insensitive organic silver salts in thermal working relationship therewith, a photosensitive silver halide in catalytic association with the mixture of substantially light-insensitive organic silver salts and a binder, wherein the mixture of substantially light-insensitive organic silver salts contains a silver salt of a monocarboxylic acid and a compound exclusive of silver succinate represented by formula (I):

$$AgOOC—R^1—COOAg$$

wherein $R^1$ is a straight chain saturated or unsaturated hydrocarbon group with two or three carbon atoms, optionally substituted with one or more of =O, =S, $=CR^2R^3$, an alkyl group, an aryl group, an amino group, a substituted amino group, a cycloalkyl group, a hydroxy group, a thiol group, an alkyl sulphone group, an aryl sulphone group, an alkoxy group, an acyloxy group, a thioalkyl group, a thioaryl, a carbamic ester group, a halogen atom or a $—(C=O)R^4$ group; wherein if $R^1$ is substituted with two substituents selected from the group consisting of alkyl, thioalkyl, substituted amino and alkoxy groups the two substituents may jointly comprise the atoms necessary to complete a carbocyclic or heterocyclic ring; $R^2$ and $R^3$ are independently hydrogen or an alkyl, substituted alkyl, hydroxy or thiol; $R^4$ is a hydroxy, —OAg, alkoxy, alkyl or $—NHR^6$ group; $R^6$ is hydrogen or an alkyl group.

According to the present invention a photothermographic recording material is also provided in an embodiment of the photothermographic recording material in which the photosensitive silver halide after exposure to UV, visible or IR light is capable of catalyzing or participating in photothermographic process.

A photothermographic recording process is also provided, according to the present invention, comprising the steps of: (i) providing a photothermographic recording material as referred to above; (ii) image-wise exposing the photoaddressable thermosensitive element with actinic radiation; (iii) bringing the image-wise exposed photothermographic recording material into proximity with a heat source; (iv) uniformly heating the image-wise exposed photothermographic recording material under substantially water-free conditions; and (v) removing the photothermographic recording material from the source.

DETAILED DESCRIPTION OF THE INVENTION

Definitions

The term mixture of substantially light-insensitive silver salts of organic carboxylic acids includes a physical mixture of separately produced substantially light-insensitive silver salts of organic carboxylic acids, coprecipitated substantially light-insensitive silver salts of organic carboxylic acids and mixed crystals of substantially light-insensitive silver salts of organic carboxylic acids.

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

Gradation is the rate at which image density changes in response to the logarithm of exposure in the case of photothermographic recording materials.

By substantially light-insensitive is meant not intentionally light sensitive.

Heating in association with the expression a substantially water-free condition as used herein, means heating at a temperature of 80 to 250° C. The term "substantially water-free condition" as used herein means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C.

Mixture of a Substantially Light-Insensitive Silver Salt of a Monocarboxylic Acid and a Compound According to Formula (I)

According to the present invention a photothermographic recording material is provided comprising a support and a photo-addressable thermally developable element, the photo-addressable thermally developable element containing a mixture of substantially light-insensitive silver salts of organic carboxylic acids with one or more carboxylic acid groups, an organic reducing agent for the mixture of substantially light-insensitive organic silver salts in thermal working relationship therewith, a photosensitive silver halide and a binder, wherein the mixture of substantially light-insensitive organic silver salts contains a silver salt of a monocarboxylic acid and a compound represented by formula (I).

Photothermographic recording materials with coprecipitated mixtures of silver stearate and silver malonate upon exposure and development exhibited poorer maximum densities and much higher fogging levels than with the coprecipitated mixtures of the present invention.

In the case of coprecipitated mixtures of silver stearate and silver glutarate, improved filterability was observed when a substoichiometric quantity of silver nitrate with respect to the equivalents of acid was used compared with the use of stoichiometric quantities of silver nitrate. This substoichiometry means that one or more of the species: stearic acid, glutaric acid and the half silver salt of glutaric acid are present.

According to a first embodiment of the photothermographic recording material according to the present invention, the compound according to formula (I) is present in a concentration of 30 to 70 mol % in the mixture of substantially light-insensitive silver salts.

A suspension of particles containing a substantially light-insensitive organic silver salt may be obtained by using processes disclosed in RD 17029, EP-A 754 969, U.S. Pat. No. 5,891,616 and EP-A 848 286.

Substantially Light-Insensitive Silver Salt of a Monocarboxylic Acid

According to a second embodiment of the photothermographic recording material according to the present invention, the substantially light-insensitive organic silver salt of a monocarboxylic acid in the mixture of substantially light-insensitive silver salts of organic carboxylic acids with one or more carboxylic acid groups is a silver salt of an aliphatic carboxylic acid known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps".

Compound According to Formula (I)

Formula (I):

$$AgOOC—R^1—COOAg \quad (I)$$

wherein $R^1$ is a straight chain saturated or unsaturated hydrocarbon group with two or three carbon atoms, optionally substituted with one or more of ═O, ═S, ═$CR^2R^3$, an alkyl group, an aryl group, an amino group, a substituted amino group, a cycloalkyl group, a hydroxy group, a thiol group, an alkyl or aryl sulphone group, an alkoxy group, an acyloxy group, a thioalkyl group, a thioaryl, a carbamic ester group, a halogen atom or a —(C═O)$R^4$ group; wherein if $R^1$ is substituted with two substituents selected from the group consisting of alkyl, thioalkyl, substituted amino and alkoxy groups the two substituents may jointly comprise the atoms necessary to complete a carbocyclic or heterocyclic ring; $R^2$ and $R^3$ are independently hydrogen or an alkyl, substituted alkyl, hydroxy or thiol; $R^4$ is a hydroxy, —OAg, alkoxy, alkyl or —$NHR^6$ group; $R^6$ is hydrogen or an alkyl group. The substituents of the amino group include alkyl groups and acyl groups, and can together provide the atoms necessary to close a heterocyclic ring Examples of suitable compounds in which $R^1$ is an optionally substituted straight chain saturated or unsaturated hydrocarbon group with two carbon atoms according to formula (I) are:

| | | |
|---|---|---|
| I-1 | AgOOCCH═CHCOOAg | silver maleate |
| I-2 | AgOOCCH═CHCOOAg | silver fumarate |
| I-3 | AgOOCC($CH_3$)═CHCOOAg | citraconic acid |
| I-4 | AgOOCC($CH_3$)═CHCOOAg | mesaconic acid |
| I-5 | $(AgOOC)_2C═C(COOAg)_2$ | silver salt of tetracarboxyethene |
| I-6 | $(AgOOC)_2CHCH(COOAg)_2$ | silver salt of 1,1,2,2-tetracarboxyethane |
| I-7 | AgOOCCH(Cl)CH(Cl)COOAg | silver salt of d-dichlorosuccinic acid |
| I-8 | AgOOCCH(Cl)CH(Cl)COOAg | silver salt of l-dichlorosuccinic acid |
| I-9 | AgOOCCH(Cl)CH(Cl)COOAg | silver salt of dl-dichlorosuccinic acid |
| I-10 | $AgOOCCH_2CH(CH_3)COOAg$ | silver 2-methylsuccinate |
| I-11 | $AgOOCCH_2C(CH_3)_2COOAg$ | silver 2,2-dimethylsuccinate |
| I-12 | $AgOOCCH(CH_3)CH(CH_3)COOAg$ | silver 2,3-dimethylsuccinate |
| I-13 | $AgOOCCH_2C(═CH_2)COOAg$ | silver salt of itaconic acid |
| I-14 | AgOOCCH(OH)CH(OH)COOAg | silver salt of d-tartaric acid |
| I-15 | AgOCCCH(OH)CH(OH)COOAg | silver salt of l-tartaric acid |
| I-16 | AgOOCCH(OH)CH(OH)COOAg | silver salt of dl-tartaric acid |
| I-17 | $AgOOCCH_2CH(OH)COOAg$ | silver salt of d-malic acid |
| I-18 | $AgOOCCH_2CH(OH)COOAg$ | silver salt of l-malic acid |
| I-19 | $AgOOCCH_2CH(OH)COOAg$ | silver salt of dl-malic acid |
| I-20 | $AgOOCCH_2C(CH_3)(OH)COOAg$ | silver salt of d-citramalic acid |
| I-21 | $AgOOCCH_2C(CH_3)(OH)COOAg$ | silver salt of l-citramalic acid |
| I-22 | $AgOOCCH_2C(CH_3)(OH)COOAg$ | silver salt of dl-citramalic acid |
| I-23 | AgOOCCH(Cl)CH(OH)COOAg | silver salt of d-chloromalic acid |
| I-24 | AgOOCCH(Cl)CH(OH)COOAg | silver salt of l-chloromalic acid |
| I-25 | AgOOCCH(Cl)CH(OH)COOAg | silver salt of dl-chloromalic acid |
| I-26 | $AgOOCCH_2CH(OCH_3)COOAg$ | silver 2-methoxysuccinate |
| I-27 | $AgOOCCH_2CH(SH)COOAg$ | silver 2-mercaptosuccinate |
| I-28 | $AgOOCCH_2CH(SCH_3)COOAg$ | |
| I-29 | $AgOOCCH_2CH(NH_2)COOAg$ | silver salt of d-aspartic acid |
| I-30 | $AgOOCCH_2CH(NH_2)COOAg$ | silver salt of l-aspartic acid |
| I-31 | $AgOOCCH_2CH(NH_2)COOAg$ | silver salt of dl-aspartic acid |
| I-32 | 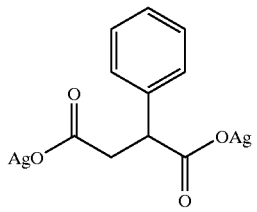 | silver 2-phenyl-succinate |
| I-33 | 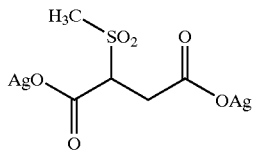 | |

-continued
| | | |
|---|---|---|
| I-34 | 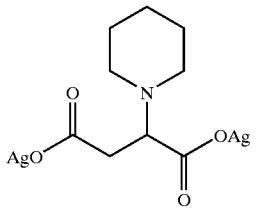 | |
| I-35 | 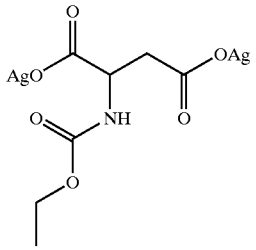 | |
| I-36 | 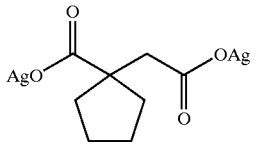 | |
| I-37 | 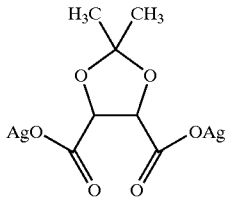 | |
| I-38 | 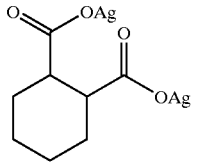 | silver cis 1,2-cyclohexanedicarboxylate |
| I-39 | 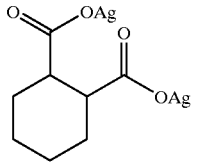 | silver trans 1,2-cyclohexanedicarboxylate |
| I-40 | 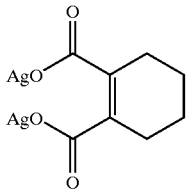 | silver 3,4,5,6-tetrahydrophthalate |
| I-41 | 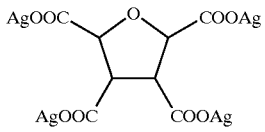 | silver salt of tetrahydrofuran-2,3,4,5-tetracarboxylic acid |

-continued

| | | |
|---|---|---|
| I-42 | 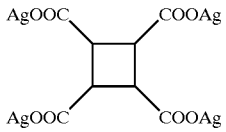 | silver salt of 1,2,3,4-cyclobutanetetracarboxylic acid |
| I-43 | 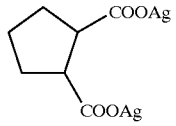 | silver 1,2-cyclopentane dicarboxylate |

Examples of suitable compounds in which $R^1$ is an optionally substituted straight chain saturated or unsaturated hydrocarbon group with three carbon atoms according to formula (I) are:

| | | |
|---|---|---|
| I-44 | $AgOOCCH_2CH_2CH_2COOAg$ | silver glutarate |
| I-45 | $AgOOCCH{=}CHCH_2COOAg$ | |
| I-46 | 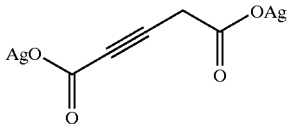 | |
| I-47 | $AgOOCCH_2C({=}CH_2)CH_2COOAg$ | |
| I-48 | $AgOOCCH{=}C(COOAg)CH_2COOAg$ | silver salt of aconitic acid |
| I-49 | $AgOOCCH_2CH_2C({=}CH_2)COOAg$ | |
| I-50 | $AgOOCCH_2CH_2CH(CH_3)COOAg$ | silver 2-methyl-glutarate |
| I-51 | $AgOOCCH_2C(CH_3)_2CH_2COOAg$ | silver 3,3-dimethyl-glutarate |
| I-52 | $AgOOCCH_2CH_2C(CH_3)_2COOAg$ | silver 2,2-dimethyl-glutarate |
| I-53 | $AgOOCCH(CH_3)CH(CH_3)CH_2COOAg$ | silver 2,3-dimethyl-glutarate |
| I-54 | $AgOOCCH_2CH(CH_3)CH_2COOAg$ | silver 3-methyl-glutarate |
| I-55 | $AgOOCCH_2C({=}CH_2)CH_2COOAg$ | silver 1,1-ethene-diacetate |
| I-56 | $AgOOCCH_2CH_2C({=}CH_2)COOAg$ | |
| I-57 | $AgOOCCH_2CH(Cl)CH_2COOAg$ | silver 3-chloroglutarate |
| I-58 | $AgOOCCH_2CH(OH)CH_2COOAg$ | silver 3-hydroxyglutarate |
| I-59 | $AgOOCCH_2CH(SH)CH_2COOAg$ | silver 3-mercaptoglutarate |
| I-60 | $AgOOCCH_2CH(NH_2)CH_2COOAg$ | silver 3-aminoglutarate |
| I-61 | 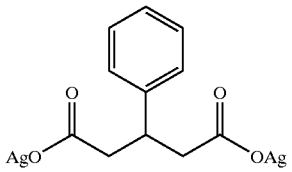 | silver 3-phenylglutarate |
| I-62 | $AgOOCCH_2CH_2CH(Cl)COOAg$ | silver 2-chloroglutarate |
| I-63 | $AgOOCCH_2CH_2CH(OH)COOAg$ | silver 2-hydroxyglutarate |
| I-64 | $AgOOCCH_2CH_2CH(SH)COOAg$ | silver 2-mercaptoglutarate |
| I-65 | $AgOOCCH_2CH_2CH(NH_2)COOAg$ | silver glutamate |
| I-66 | $AgOOCCH_2C({=}O)CH_2COOAg$ | silver 1,3-acetone-dicarboxylate |
| I-67 | $AgOOCCH_2CH_2C({=}O)COOAg$ | silver α-ketoglutarate |
| I-68 | $AgOOCCH_2C(OH)(COOAg)CH_2COOAg$ | silver citrate |
| I-69 | $AgOOCCH_2CH(COOAg)CH(OH)COOAg$ | silver isocitrate |
| I-70 | $AgOOCCH_2CH(COOAg)CH_2COOAg$ | silver salt of propane-1,2,3 tricarboxylic acid |
| I-71 | 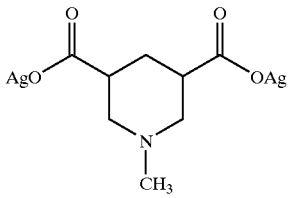 | |

-continued

| | | |
|---|---|---|
| I-72 | 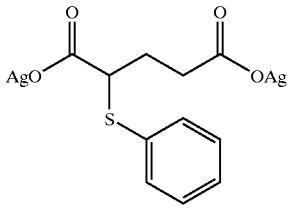 | |
| I-73 | 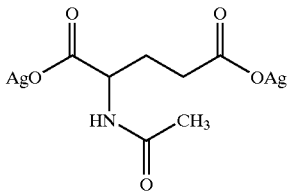 | |
| I-74 | 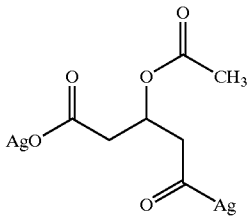 | |
| I-75 | 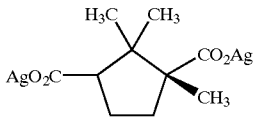 | silver salt of camphoric acid |
| I-76 | 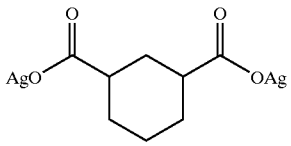 | silver cis 1,3-cyclohexanedicarboxylate |
| I-77 | 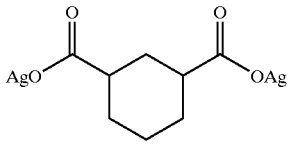 | silver trans 1,3-cyclohexanedicarboxylate |
| I-78 | 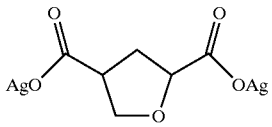 | silver tetrahydrofuran-2,4-dicarboxylate |
| I-79 | 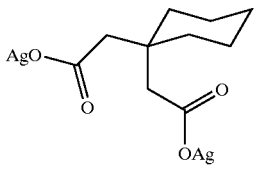 | silver 1,1-cyclohexane diacetate |
| I-80 | 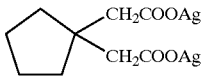 | silver 3,3-tetramethylene-glutarate |

According to a third embodiment of the photothermographic recording material according to the present invention, the compound according to formula (I) is selected from the group consisting of silver glutarate, silver 2-methyl glutarate, silver 3-methyl glutarate, silver 1,1-cyclopentane diacetic acetate, silver 1,1-cyclohexane diacetate, silver 1,3-cyclohexane dicarboxylate, silver citrate, silver citramalate, silver 2-methyl-succinate, silver 1,2-cyclohexane dicarboxylate, silver 3,3-tetramethylene-glutarate, silver 1,2-cyclopentane dicarboxylate, silver malate, silver tartarate, silver tetrahydrofuran-2,3,4,5-tetracarboxylate and silver itaconate. No image could be obtained with photothermographic recording materials with a mixture of a silver salt of a monocarboxylic acid and silver succinate.

According to a fourth embodiment of the photothermographic recording material according to the present invention, the compound according to formula (I) is selected from the group consisting of silver glutarate, silver 2-methyl succinate, silver 2,2-dimethyl-glutarate, silver 3-methylglutarate, silver tetrahydrofuran-2,3,4,5-tetracarboxylate and silver itaconate.

Many of the dicarboxylic acids of which compounds according to formula (I) are silver salts, are commercially available. If such dicarboxylic acids are not commercially available such compounds can be prepared according to standard synthetic techniques known to organic chemists.

Photo-Addressable Thermally Developable Element

The photo-addressable thermally developable element, according to the photothermographic recording material of the present invention, comprises a mixture of a substantially light-insensitive silver salt of a monocarboxylic acid and a compound according to formula (I), an organic reducing agent therefor in thermal working relationship therewith, a photosensitive silver halide in catalytic association with the mixture of a substantially light-insensitive silver salt of a monocarboxylic acid and a compound according to formula (I) and a binder. The element may comprise a layer system in which the ingredients may be dispersed in different layers, with the provisos that the substantially light-insensitive organic silver salts and the organic reducing agent are in thermal working relationship with one another i.e. during the thermal development process the reducing agent must be present in such a way that it is able to diffuse to the substantially light-insensitive organic silver salt particles so that reduction of the organic silver salt can take place, and that the photosensitive silver halide is in catalytic association with the mixture of a substantially light-insensitive silver salt of a monocarboxylic acid and a compound according to formula (I) so that the photosensitive silver halide after exposure to UV, visible or IR light is capable of catalyzing or participating in a photothermographic process7.

Reducing Agents

Suitable organic reducing agents for the reduction of the mixture of a substantially light-insensitive silver salt of a monocarboxylic acid and a compound according to formula (I) are organic compounds containing at least one active hydrogen atom linked to O, N or C, such as is the case with, aromatic di- and tri-hydroxy compounds.

According to a fifth embodiment of the photothermographic recording material according to the present invention, the organic reducing agent is a 1,2-dihydroxybenzene derivative, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters.

According to a sixth embodiment of the photothermographic recording material according to the present invention, the organic reducing agent is a polyphenol such as the bisphenols used in the 3M Dry Silver™ materials, a sulfonamide phenol such as used in the Kodak Dacomatic™ materials or a naphthol.

Combinations of reducing agents may also be used that on heating become reactive partners in the reduction of the substantially light-insensitive organic silver salts. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. Nos. 5,545,505, 5,545,507 and 5,558,983; acrylonitrile compounds as disclosed in U.S. Pat. Nos. 5,545,515 and 5,635,339; 2-substituted malonodialdehyde compounds as disclosed in U.S. Pat. No. 5,654,130; and compounds with general formula: $R_1R_3C{=}CH{-}NH{-}NH{-}R_2$ where $R_1$ is —CN or $R_4CO$—; $R_2$ is hydrogen, an alkyl group or an optionally substituted aryl group with a maximum of 12 carbon atoms; $R_3$ is an alkyl, an aryl, an acyl or an alkoxycarbonyl group with a maximum of 12 carbon atoms; $R_4$ is an alkyl, alkoxy or alkamino group with 1 to 6 carbon atoms or an amino group as disclosed in DE 195 16349.

Film-Forming Binders for the Photo-Addressable Thermally Developable Element

The film-forming binder for the photo-addressable thermally developable element according to the present invention may be coatable from a solvent or aqueous dispersion medium.

The film-forming binder for the at least one layer comprising the photo-addressable thermally developable element coating from solvent media, according to the present invention, may be all kinds of natural, modified natural or synthetic resins or mixtures of such resins, wherein the organic silver salt can be dispersed homogeneously: e.g. polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyrals containing a minor amount of vinyl alcohol units are marketed under the trade name BUTVAR™ B76 and BUTVAR™ B79 of Monsanto USA and provides a good adhesion to paper and properly subbed polyester supports.

The film-forming binder for the at least one layer comprising the photo-addressable thermally developable element coatable from aqueous media, according to the present invention, may be all kinds of transparent or translucent water-dispersible or water soluble natural, modified natural or synthetic resins or mixtures of such resins, wherein the organic silver salt can be dispersed homogeneously for example proteins, such as gelatin and gelatin derivatives (e.g. phthaloyl gelatin), cellulose derivatives, such as carboxymethylcellulose, polysaccharides, such as dextran, starch ethers etc., galactomannan, polyvinyl alcohol, polyvinylpyrrolidone, acrylamide polymers, homo- or co-polymerized acrylic or methacrylic acid, latexes of water dispersible polymers, with or without hydrophilic groups, or mixtures thereof.

The above mentioned binders or mixtures thereof may be used in conjunction with waxes or "heat solvents" also called "thermal solvents" or "thermosolvents" improving the reaction speed of the redox-reaction at elevated temperature.

Toning Agent

According to a seventh embodiment of the photothermographic recording material according to the present invention, the photo-addressable thermally developable element further contains a so-called toning agent in order to obtain a neutral black image tone in the higher densities and neutral grey in the lower densities.

Suitable toning agents are the phthalimides and phthalazinones within the scope of the general formulae described in U.S. Pat. No. 4,082,901 and the toning agents described in U.S. Pat. Nos. 3,074,809, 3,446,648 and 3,844,797. Other particularly useful toning agents are the heterocyclic toner compounds of the benzoxazine dione or naphthoxazine dione type as disclosed in GB 1,439,478, U.S. Pat. Nos. 3,951,660 and 5,599,647 and pyridazone as disclosed in DE 19516349.

Aromatic Polycarboxylic Acids and Anhydrides Thereof

According to the recording material of the present invention the photo-addressable thermally developable element may comprise at least one aromatic polycarboxylic acid and/or anhydride such as ortho-phthalic acid, 3-nitrophthalic acid and tetrachlorophthalic acid and anhydrides thereof.

Antifoggants

Antifoggants may be incorporated into the photothermographic recording materials of the present invention in order to obtain improved shelf-life and reduced fogging.

According to an eighth embodiment of the photothermographic recording material according to the present invention, the photo-addressable thermally developable element further contains at least one antifoggant selected from the group consisting of hexamethylene tetramine (see EP 557 859 and U.S. Pat. No. 5,459,028), substituted pyridazones (see DE 195 16350), benzotriazole, substituted benzotriazoles, tetrazoles and mercaptotetrazoles.

According to a ninth embodiment of the photothermographic recording material according to the present invention, the photo-addressable thermally developable element further contains hexamethylene tetramine.

Photosensitive Silver Halide

The photosensitive silver halide used in the present invention may be employed in a range of 0.75 to 25 mol percent and, preferably, from 2 to 20 mol percent of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Spectral Sensitizer

The photo-addressable thermally developable element of the photothermographic recording material, according to the present invention, may contain a spectral sensitizer, optionally together with a supersensitizer, for the silver halide. The silver halide may be spectrally sensitized with various known dyes including cyanine, merocyanine, styryl, hemicyanine, oxonol, hemioxonol and xanthene dyes optionally, particularly in the case of sensitization to infrared radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective.

Anti-Halation Dyes

In addition to the ingredients, the photothermographic recording material of the present invention may contain anti-halation or acutance dyes which absorb light which has passed through the photosensitive layer, thereby preventing its reflection. Such dyes may be incorporated into the photo-addressable thermally developable element or in any other layer comprising the photothermographic recording material of the present invention.

Other Additives

In addition to the ingredients the photo-addressable thermally developable element may contain other additives such as free fatty acids, surface-active agents, e.g. non-ionic antistatic agents including a fluorocarbon group as e.g. in $F_3C(CF_2)_6CONH(CH_2CH_2O)$—H, silicone oil, e.g. BAYSILONE™ Öl A (from BAYER AG, GERMANY), ultraviolet light absorbing compounds, white light reflecting and/or ultraviolet radiation reflecting pigments, silica, colloidal silica, fine polymeric particles [e.g. of poly (methylmethacrylate)] and/or optical brightening agents.

Support

The support for the photothermographic recording material according to the present invention may be transparent or translucent and is a thin flexible carrier made of transparent resin film, e.g. made of a cellulose ester, cellulose triacetate, polypropylene, polycarbonate or polyester, e.g. polyethylene terephthalate.

The support may be in sheet, ribbon or web form and subbed if needs be to improve the adherence to the thereon coated photo-addressable thermally developable element.

Suitable pretreatments of supports are, for example, treatment with a corona discharge and/or attack by solvent(s), thereby providing a micro-roughening. The support may be pigmented with a blue pigment as in so-called blue-base. One or more backing layers may be provided to control physical properties such as curl and static.

Protective Layer

According to a tenth embodiment of the photothermographic recording material of the present invention, the photo-addressable thermally developable element is provided with a protective layer to avoid local deformation of the photo-addressable thermally developable element and to improve resistance against abrasion.

According to an eleventh embodiment of the photothermographic recording material of the present invention, the photo-addressable thermally developable element is provided with a protective layer comprising a binder, which may be solvent-soluble, solvent-dispersible, water-soluble or water-dispersible.

According to a twelfth embodiment of the photothermographic recording material of the present invention, the photo-addressable thermally developable element is provided with a protective layer comprising solvent-soluble polycarbonates as binders as described in EP-A 614 769.

According to a thirteenth embodiment of the photothermographic recording material of the present invention, the photo-addressable thermally developable element is provided with a protective layer comprising a water-soluble or water-dispersible binder, as coating can be performed from an aqueous composition and mixing of the protective layer with the immediate underlayer can be avoided by using a solvent-soluble or solvent-dispersible binder in the immediate underlayer.

The protective layer according to the present invention may be crosslinked. Crosslinking can be achieved by using crosslinking agents such as described in WO 95/12495.

Solid or liquid lubricants or combinations thereof are suitable for improving the slip characteristics of the photothermographic recording materials according to the present invention.

According to an fourteenth of the photothermographic recording material of the present invention, the photo-addressable thermally developable element is provided with a protective layer comprising a solid thermomeltable lubricant such as those described in WO 94/11199.

The protective layer of the photothermographic recording material according to the present invention may comprise a matting agent. According to a fifteenth embodiment of the photothermographic recording material of the present invention, the photo-addressable thermally developable element is provided with a protective layer comprising a matting agent such as described in WO 94/11198, e.g. talc particles, and optionally protrude from the protective layer.

Coating

The coating of any layer of the photothermographic recording materials of the present invention may proceed by any thin-film coating technique known in the art. In the coating of web type supports for photographic materials slide hopper coating is used advantageously, but other coating techniques such as dip coating and air knife coating may also be used. Details about such coating techniques can be found in "Modern Coating and Drying Technology" y Edward D. Cohen and Edgar B. Gutoff, published by VCH Publishers, Inc. 220 East 23rd Street, Suite 909 New York, N.Y. 10010.

Recording Process for Photothermographic Recording Materials

Photothermographic recording materials, according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the aspect itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating with for example a heated roller or a thermal head, radiative heating, microwave heating etc.

Applications

The photothermographic recording materials of the present invention can be used for both the production of transparencies and reflection type prints. This means that the support will be transparent or opaque, e.g. having a white light reflecting aspect. Should a transparent base be used, the base may be colourless or coloured, e.g. has a blue colour.

In the hard copy field recording materials on a white opaque base are used, whereas in the medical diagnostic field black-imaged transparencies are widely used in inspection techniques operating with a light box.

Application of the present invention is envisaged in the fields of both graphics images requiring high contrast images with a very steep print density applied dot energy dependence and continuous tone images requiring a weaker print density applied dot energy dependence, such as required in the medical diagnostic field.

The following ingredients were used in the INVENTION and COMPARATIVE EXAMPLES of the present invention:

Photo-addressable thermally developable element:

- TRITON™ X100, a non-ionic nonyl-phenyl-polyethyleneglycol surfactant from UNION CARBIDE;
- PVP K30, a polyvinylpyrrolidone from Aldrich;
- PVP K90, a polyvinylpyrrolidone with an Mw of ca. 70,000 from Aldrich;
- K7598, =Type 7598, a calcium-free gelatin from AGFA-GEVAERT GELATINEFABRIEK;
- BMPS, tribromomethylphenylsulfone;
- MOWIOL™ 10-98, a polyvinyl alcohol from DEGUSSA.

The following examples illustrate the present invention without however limiting it thereto. All percentages, parts and ratios are by weight unless otherwise mentioned.

Preparation of Mixtures 01 to 04 of a Silver Salt of a Monocarboxylic Acid and Silver Glutarate Mixture 01:

Solution A was prepared by mixing 1000 g of deionized water, 85 g (0.5 moles) of silver nitrate, 15 g of 6.5% nitric acid and 2.0 g of mercuric nitrate at 60° C.

Solution B was prepared by mixing 2000 g of deionized water, 26.4 g (0.2 moles) of glutaric acid and 22.7 g (0.57 moles) of sodium hydroxide and 50.0 g of stearic acid (0.176 moles) at 70° C. and had a pH of 8.8.

Solution A at 60° C. was added to solution B at 70° C. in 10 s and the resulting Mixture 01 stirred for 2 minutes and then cooled to room temperature. The precipitate was then filtered off, washed and dried yielding 120 g of solids consisting of silver glutarate, silver stearate, stearic acid, glutaric acid and mercuric stearate-glutarate.

Mixture 02:

Solution C was prepared by mixing 1000 g of deionized water, 85 g (0.5 moles) of silver nitrate, 15 g of 6.5% nitric acid and 2.0 g of mercuric nitrate at 60° C.

Solution D was prepared by mixing 2000 g of deionized water, 8.5 g (0.14 moles) of glutaric acid and 22.7 g (0.57 moles) of sodium hydroxide and 79.7 g of stearic acid (0.28 moles) at 70° C. and had a pH of 9.0.

Solution C at 60° C. was added to solution D at 70° C. in 10 s and the resulting mixture stirred for 2 minutes and then cooled to room temperature. The precipitate was then filtered off, washed and dried yielding 122.5 g of solids consisting of silver glutarate, silver stearate, stearic acid, glutaric acid and mercuric stearate-glutarate.

Mixture 03:

A mixture of 76 mol % of silver behenate and 24 mol % of silver glutarate was produced by adding 0.75M aqueous sodium hydroxide to a mixture of 0.456 mol of behenic acid and 0.144 mol of glutaric acid in 750 mL to a pH of 8.7 and a UAg of 167 mV and then converting the resulting sodium salts into silver salts by adding 0.8M aqueous silver nitrate until a UAg of 425 mV and pH of 6.08 was realized, whereupon the mixture of silver salts precipitated out was washed and dried producing Mixture 03. The yield was 100%.

Mixture 04:

A mixture of 66.7 mol % of silver behenate and 33.3 mol % of silver glutarate was produced by adding 0.75M aqueous sodium hydroxide to a mixture of 0.375 mol of behenic acid and 0.1875 mol of glutaric acid in 750 mL to a pH of 8.5 and a UAg of 207 mV and then converting the resulting sodium salts into silver salts by adding 0.8M aqueous silver nitrate until a UAg of 422 mV and pH of 6.7 was realized, whereupon the mixture of silver salts precipitated out was washed and dried producing Mixture 03. The yield was 100%.

Characterization:

X-ray diffraction spectra carried out on Mixtures 01 to 04 showed the presence of the silver salt of a monocarboxylic acid (i.e. silver stearate in the cases of Mixtures 01 and 02 and silver behenate in the cases of Mixtures 03 and 04 and that of silver glutarate (characterized by a 20 peak at 8.530) and provided no evidence for the presence of mixed salts. Furthermore, the crystallinity of the mixtures of silver stearate and silver glutarate and silver behenate and silver glutarate was fairly low.

INVENTION EXAMPLES 1 and 2

First Layer of Photo-Addressable Thermally Developable Element

An emulsion for the first layer of the photo-addressable thermally developable elements of INVENTION EXAMPLES 1 and 2 was prepared by mixing the following ingredients and solvents in the following order:

| | |
|---|---|
| Mixture 01: silver stearate/silver glutarate/stearic acid/glutaric acid/mercuric stearate-glutarate mixture | 120 g |

-continued

| | |
|---|---|
| Methanol | 720 g |
| TRITON ™ X100 | 4.8 g |
| behenic acid | 3.6 g |
| 5-nitro-indazole | 1.2 g |
| phthalic anhydride | 16.8 g |
| Polyvinylpyrrolidone K30 | 30 g |
| Methanol | 90 g |
| mercuric bromide | 0.48 g |
| Methanol | 20 g |

and then pearl milling the resulting mixture at 0° C. for 8 hours. The photo-addressable thermally developable emulsion was then coated onto a subbed polyethylene terephthalate support to a wet layer thickness of 100 μm thereby producing after drying the first layer of the photo-addressable thermally developable element.

Second Layer of Photo-Addressable Thermally Developable Element

The emulsion for the second layer of the photo-addressable thermally developable elements of INVENTION EXAMPLES 1 and 2 were prepared by mixing:

| | INVENTION EXAMPLE 1 | INVENTION EXAMPLE 2 |
|---|---|---|
| Ethyl acetate | 480 g | 480 g |
| Cellulose propionate | 40 g | 40 g |
| isobutanol | 160 g | 160 g |
| Hexamethylene tetramine | — | 12 g |
| FC 430, a non-ionic fluorosurfactant | 1 g | 1 g |
| bis(2-hydroxy-3,5-dimethyl-phenyl) methane | 14 g | 14 g |
| Pyridazone | 5 g | 5 g |
| Hydrazino-methylene-malonic acid ester | 2.5 g | 2.5 g |
| Phthalic acid | 2.5 g | 2.5 g |

then coating the mixture on the first layer of the photo-addressable thermally developable element to a wet thickness of 100 μm and finally drying to form the second layer of the photo-addressable thermally developable element thereby producing a photothermographic recording material.

Photothermographic Evaluation

The photothermographic recording materials of INVENTION EXAMPLES 1 and 2 were exposed through a wedge in a KLINSCH VACUPRINT™ apparatus fitted with a mercury lamp to UV light for 10 s and then the exposed material was uniformly heated at 105° C. for 15 s to produce a wedge image. The wedge image was evaluated with a MACBETH TD504 transmission densitometer to give Dmax, Dmin and the gradation γ, where γ is defined as:

$$\gamma = \frac{2.5 - 0.3}{[(\log It(D = 2.5) - (\log It(D = 0.3)]}$$

where:

logIt(D=2.5) is the logarithm of the exposure It needed to obtain an optical density of 2.5; and logIt(D=0.3) is the logarithm of the exposure It needed to obtain an optical density of 0.3.

The results for INVENTION EXAMPLES 1 and 2 are summarized in Table 1 below.

TABLE 1

| | INVENTION EXAMPLE 1 | INVENTION EXAMPLE 2 |
|---|---|---|
| Dmax | 2.0 | 4.0 |
| Dmin | 0.1 | <0.10 |
| γ | 1.1 | 3–5 |

The results show image formation with excellent contrast, as indicated by the low $D_{min}$-values, and high developability, as indicated by the low thermal development temperature. The presence of hexamethylene tetramine in the second layer of the photo-addressable thermally developable element of the photothermographic recording materials of INVENTION EXAMPLE 2 resulted in a still higher developability, as indicated by the higher $D_{max}$-value, and a higher γ-value, indicating a higher image gradation than for the photothermographic recording material of INVENTION EXAMPLE 1.

INVENTION EXAMPLE 3

Preparation of a High Sensitivity Photothermographic Material

An emulsion for the first layer of the photo-addressable thermally developable element of the high sensitivity photothermographic recording material was prepared by adding 10 g of a 52.2% by weight emulsion with respect to silver of 0.1 μm edge-length cubic silver bromide grains in which the gelatin had been removed by degradation beforehand by enzymatic degradation using the enzyme trypsin, which was obtained from MERCK. The resulting emulsion was coated onto a subbed polyethylene terephthalate support to a wet thickness of 100 μm. After drying it was overcoated as described in INVENTION EXAMPLE 2 to a wet thickness of 100 μm.

Photothermographic Evaluation

The photothermographic recording material prepared as described above was exposed through a wedge in a KLINSCH VACUPRINT™ apparatus filled with a mercury lamp to UV light for Is at 100 lux and then the exposed material was uniformly heated at 105° C. for 15 s to produce a wedge image. Evaluation of the wedge image as described for INVENTION EXAMPLES 1 and 2 yielded a $D_{max}$=3.8, a $D_{min}$<0.10 and a gradation, γ, of 10–15.

A higher gradation value, γ, was obtained than with the photothermographic recording material of INVENTION EXAMPLE 2.

INVENTION EXAMPLE 4

The photo-addressable thermally developable element of INVENTION EXAMPLE 4 was coated as described for the photo-addressable thermally developable element of INVENTION EXAMPLE 3 except that Mixture 02 of silver stearate and silver glutarate was used instead of Mixture 01 and the resulting photothermographic recording material evaluated as described for the photothermographic recording materials of INVENTION EXAMPLES 1 and 2. Evaluation of the wedge image as described for INVENTION EXAMPLES 1 and 2 yielded a $D_{max}$=3.3, a $D_{min}$= 0.12 and a gradation, γ, of 12.

These results show that the use of a coprecipitated mixture of silver stearate and silver glutarate with a molar ratio of 2:1 i.e. an equi-equivalent ratio with respect to silver produced a developability intermediate between that of silver stearate and a coprecipitated mixture of silver stearate to silver glutarate with a molar ratio of 1:1.

COMPARATIVE EXAMPLE 1

Preparation of an Emulsion Only Containing Silver Stearate

Solution A was prepared by mixing 1000 g of deionized water, 85 g (0.5 moles) of silver nitrate, 15 g of 6.5% nitric acid and 2.0 g of mercuric nitrate at 60° C.

Solution B was prepared by mixing 2000 g of deionized water, 162.0 g of stearic acid (0.57 moles) and 22.7 g (0.57 moles) of sodium hydroxide at 70° C. and had a pH of 9.0.

Solution A at 60° C. was added to solution B at 70° C. in 10 s and the resulting mixture stirred for 2 minutes and then cooled to room temperature. The precipitate was then filtered off, washed and dried yielding 120 g of solids consisting of silver stearate, stearic acid, and mercuric stearate.

Preparation of a High Sensitivity Photothermographic Recording Material Only Containing Silver Stearate The photo-addressable thermally developable element of the high sensitivity photothermographic recording material was prepared as described in INVENTION EXAMPLE 3 except that the above-described silver stearate emulsion was used instead of the silver stearate/silver glutarate emulsion of INVENTION EXAMPLES 1 and 2.

Photothermographic Evaluation

The photothermographic recording material prepared as described above was exposed through a wedge in a KLINSCH VACUPRINT™ apparatus fitted with a mercury lamp to UV light for 1 s at 100 lux and then the exposed material was uniformly heated at 105° C. for 15 s to produce a wedge image. Evaluation of the wedge image as described for INVENTION EXAMPLES 1 and 2 yielded a $D_{max}$=2.5, a $D_{min}$<0.15 and a gradation, γ, of 10.

$D_{max}$ was significantly lower in the absence of silver glutarate, Dmin significantly higher and the gradation, γ, significantly lower, indicating the benefit of the use of a mixture of silver stearate and silver glutarate over the use of silver stearate alone.

COMPARATIVE EXAMPLES 2 AND 3

In COMPARATIVE EXAMPLES 2 and 3, COMPARATIVE EXAMPLE 1 was repeated with silver palmitate and silver glutarate being used respectively instead of silver stearate.

The photothermographic recording material of COMPARATIVE EXAMPLE 2 with silver palmitate was grey and fogged after 3 days in the refrigerator.

The photothermographic recording material of COMPARATIVE EXAMPLE 3 with silver glutarate was difficult to prepare because the silver glutarate is formed in large crystals which are difficult to grind. Furthermore, although the fresh photothermographic recording material had a high $D_{max}$ and normal speed, after aging for 7 days only a very low $D_{max}$ of ca. 0.5 could be attained after prolonged processing (ca, 30–60 s at 105° C.).

COMPARATIVE EXAMPLES 4 TO 7

In COMPARATIVE EXAMPLES 4 to 7, INVENTION EXAMPLES 1 and 3 were repeated using mixtures of substantially light-insensitive silver salts of dicarboxylic acids outside the scope of the instant invention as summarized in Table 2.

When INVENTION EXAMPLE 1 was repeated with these mixtures of silver salts of dicarboxylic acids i.e. in the absence of added silver bromide, $D_{max}$ was ca. 0.1 even after thermal development times at 105° C. of 120 s. Therefore thermal development at 105° C. is not possible with these mixtures of substantially light-insensitive silver salts of carboxylic acids. This indicates that the melting point of the corresponding acids to the organic silver salts cannot explain the exceptional properties of the silver glutarate/silver stearate mixture of silver salts.

TABLE 2

| Comparative | | Corresponding acid to silver salt | | | Corresponding acid to silver salt | |
|---|---|---|---|---|---|---|
| Example nr | Component 1 | Carbon atoms | Melting point in ° C. | Component 2 | Carbon atoms | Melting point in ° C. |
| 4 | silver glutarate | 5 | 95–98 | silver adipate | 6 | 152–154 |
| 5 | silver glutarate | 5 | 95–98 | silver sebacate | 10 | 133–137 |
| 6 | silver glutarate | 5 | 95–98 | silver pimelate | 7 | 103–105 |
| 7 | silver pimelate | 7 | 103–105 | silver azealate | 9 | 109–111 |

Having described in detail preferred embodiments of the current invention, it will now be apparent to those skilled in the art that numerous modifications can be made therein without departing from the scope of the invention as defined in the following claims.

I claim:

1. A photothermographic recording material comprising a support and a photo-addressable thermally developable element, said photo-addressable thermally developable element containing a mixture of substantially light-insensitive silver salts of organic carboxylic acids with one or more carboxylic acid groups, an organic reducing agent for said mixture of substantially light-insensitive organic silver salts in thermal working relationship therewith, a photosensitive silver halide in catalytic association with said mixture of substantially light-insensitive silver salts of organic carboxylic acids with one or more carboxylic acid groups and a binder, wherein said mixture of substantially light-insensitive organic silver salts contains a silver salt of a monocarboxylic acid and a compound exclusive of silver succinate represented by formula (I):

$$AgOOC—R^1—COOAg$$

wherein $R^1$ is a straight chain saturated or unsaturated hydrocarbon group with two or three carbon atoms, optionally substituted with one or more of ═O, ═S, ═$CR^2R^3$, an alkyl group, an aryl group, an amino group, a substituted amino group, a cycloalkyl group, a hydroxy group, a thiol group, an alkyl sulphone group, an aryl sulphone group, an alkoxy group, an acyloxy group, a thioalkyl group, a thioaryl, a carbamic ester group, a halogen atom or a —(C═O)$R^4$ group; wherein if $R^1$ is substituted with two substituents selected from the group consisting of alkyl, thioalkyl, substituted amino and alkoxy groups said two substituents may jointly comprise the atoms necessary to complete a carbocyclic or heterocyclic ring; $R^2$ and $R^3$ are independently hydrogen or an alkyl, substituted alkyl, hydroxy or thiol; $R^4$ is a hydroxy, —OAg, alkoxy, alkyl or —$NHR^6$ group; $R^6$ is hydrogen or an alkyl group.

2. Photothermographic recording material according to claim 1, wherein said compound according to formula (I) is selected from the group consisting of silver glutarate, silver 2-methyl succinate, silver 2,2-dimethyl-glutarate, silver 3-methylglutarate, silver tetrahydrofuran-2,3,4,5-tetracarboxylate and silver itaconate.

3. Photothermographic recording material according to claim 1, wherein said silver salt of a monocarboxylic acid has at least 14 carbon atoms.

4. Photothermographic recording material according to claim 3, wherein said silver salt of a monocarboxylic acid is selected from the group consisting of silver palmitate, silver stearate and silver behenate.

5. Photothermographic recording material according to claim 1, wherein said compound according to formula (I) is present in a concentration of 30 to 70 mol % in said mixture of substantially light-insensitive silver salts.

6. Photothermographic recording material according to claim 1, wherein said photo-addressable thermally developable element further comprises a developed image stabilizer selected from the group consisting of hexamethylene tetramine and salts thereof, triazaadamantane and salts thereof and compounds derived from hexamethylene tetramine wherein the compounds are derived from hexamethylene tetramine by exchanging one —$CH_2$— group with —S—, —SO—, or —$SO_2$—; and wherein said reducing agent and said developed image stabilizers are in a reactive relationship with the mixture of light-insensitive silver salts.

7. A photothermographic recording process comprising the steps of:

(i) providing a photothermographic recording material, comprising a support and a photo-addressable thermally developable element, said photo-addressable thermally developable element containing a mixture of a silver salt of a monocarboxylic acid and a compound exclusive of silver succinate represented by formula (I):

$$AgOOC—R^1—COOAg$$

wherein $R^1$ is a straight chain saturated or unsaturated hydrocarbon group with two or three carbon atoms, optionally substituted with one or more of ═O, ═S, ═$CR^2R^3$, an alkyl group, an aryl group, an amino group, a substituted amino group, a cycloalkyl group, a hydroxy group, a thiol group, an alkyl or aryl sulphone group, an alkoxy group, an acyloxy group, a thioalkyl group, a thioaryl, a carbamic ester group, a halogen atom or a —(C═O)$R^4$ group; wherein if $R^1$ is substituted with two substituents selected from the group consisting of alkyl, thioalkyl, substituted amino and alkoxy groups said two substituents may jointly comprise the atoms necessary to complete a carbocyclic or heterocyclic ring; $R^2$ and $R^3$ are independently hydrogen or an alkyl, substituted alkyl, hydroxy or thiol; $R^4$ is a hydroxy, —OAg, alkoxy, alkyl or —$NHR^6$ group; $R^6$ is hydrogen or an alkyl group; an organic reducing agent for said mixture of substantially light-insensitive organic silver salts in thermal working relationship therewith, a photosensitive silver halide in catalytic association with said mixture of organic silver salts and a binder; (ii) image-wise exposing said photo-addressable thermally developable element is with actinic radiation; (iii) bringing said image-wise exposed photothermographic recording material into proximity with a heat source; (iv) uniformly heating said image-wise exposed photothermographic recording material under substantially water-free conditions; and (v) removing said photothermographic recording material from said heat source.

8. Photothermographic recording material according to claim 1, wherein the recording material has a $D_{max}$ of 2 or greater when developed at a temperature of 105° C.

9. A photothermographic recording material comprising a support and a photo-addressable thermally developable element, said photo-addressable thermally developable element containing a mixture of substantially light-insensitive silver salts of organic carboxylic acids with one or more carboxylic acid groups, an organic reducing agent for said mixture of substantially light-insensitive organic silver salts in thermal working relationship therewith, a photosensitive silver halide in catalytic association with said mixture of substantially light-insensitive silver salts of organic carboxylic acids with one or more carboxylic acid groups and a binder, wherein said mixture of substantially light-insensitive organic silver salts is coprecipitated or a physical mixture and contains a silver salt of a monocarboxylic acid and a compound exclusive of silver succinate represented by formula (I):

$$AgOOC—R^1—COOAg$$

wherein $R^1$ is a straight chain saturated or unsaturated hydrocarbon group with two or three carbon atoms, optionally substituted with one or more of ═O, ═S, ═$CR^2R^3$, an alkyl group, an aryl group, an amino group, a substituted amino group, a cycloalkyl group, a hydroxy group, a thiol group, an alkyl sulphone group, an aryl sulphone group, an alkoxy group, an acyloxy group, a thioalkyl group, a thioaryl, a carbamic ester group, a halogen atom or a —(C═O)$R^4$ group; wherein if $R^1$ is substituted with two substituents selected from the group consisting of alkyl, thioalkyl, substituted amino and alkoxy groups said two substituents may jointly comprise the atoms necessary to complete a carbocyclic or heterocyclic ring; $R^2$ and $R^3$ are independently hydrogen or an alkyl, substituted alkyl, hydroxy or thiol; $R^4$ is a hydroxy, —OAg, alkoxy, alkyl or —$NHR^6$ group; $R^6$ is hydrogen or an alkyl group.

* * * * *